US012269634B2

(12) United States Patent
Bassissi et al.

(10) Patent No.: US 12,269,634 B2
(45) Date of Patent: Apr. 8, 2025

(54) METHOD FOR CONTROLLING A PLURALITY OF CARTS MOVABLE ALONG AN ENDLESS TRACK

(71) Applicant: Tetra Laval Holdings & Finance S.A., Pully (CH)

(72) Inventors: Fabio Bassissi, Modena (IT); Stefano Rossi, Reggio Emilia (IT); Claudio Palomba, Modena (IT); Luca Capelli, Novellara Reggio Emilia (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 98 days.

(21) Appl. No.: 17/801,132

(22) PCT Filed: Mar. 12, 2021

(86) PCT No.: PCT/EP2021/056371
§ 371 (c)(1),
(2) Date: Aug. 19, 2022

(87) PCT Pub. No.: WO2021/185698
PCT Pub. Date: Sep. 23, 2021

(65) Prior Publication Data

US 2023/0086224 A1 Mar. 23, 2023

(30) Foreign Application Priority Data

Mar. 20, 2020 (EP) ..... 20164424

(51) Int. Cl.
*B65B 43/52* (2006.01)
*B65B 7/28* (2006.01)
(Continued)

(52) U.S. Cl.
CPC ..... *B65B 43/52* (2013.01); *B65B 7/2807* (2013.01); *B65B 7/2871* (2013.01); *B65B 57/08* (2013.01); *B65B 61/186* (2013.01); *B65B 65/02* (2013.01)

(58) Field of Classification Search
CPC ..... B65B 43/52; B65B 7/2807; B65B 7/2871; B65B 57/08; B65B 61/186; B65B 65/02
See application file for complete search history.

(56) References Cited

U.S. PATENT DOCUMENTS

2003/0136086 A1* 7/2003 Kalany ..... B65G 47/52 53/251
2003/0230941 A1* 12/2003 Jacobs ..... B65G 47/841 310/12.19
(Continued)

FOREIGN PATENT DOCUMENTS

EP 2746175 A1 6/2014
EP 2927132 A1 10/2015
(Continued)

OTHER PUBLICATIONS

International Search Report mailed May 14, 2021, for priority International Patent Application No. PCT/EP2021/056371.

*Primary Examiner* — Thomas M Wittenschlaeger
*Assistant Examiner* — Katie L Gerth
(74) *Attorney, Agent, or Firm* — Renner, Otto, Boisselle & Sklar, LLP

(57) ABSTRACT

A method for controlling a plurality of carts movable independently from one another along an endless track and configured to perform at least one task in order to carry out at least one operation onto respective articles; the method including the steps of: advancing the carts along the track, the track including at least one task section and at least one transient section; advancing each cart along a task-assignment section of the track arranged upstream of the at least
(Continued)

one task section; advancing a plurality of articles along a feeding path and through an operation station; detecting the passage of each article at a detection station of the feeding path located upstream of the operation station; and controlling one respective cart to perform the at least one task if an article is detected, during the step d) of detecting, when the cart is moving along the task-assignment section.

9 Claims, 3 Drawing Sheets

(51) Int. Cl.

| | |
|---|---|
| ***B65B 57/08*** | (2006.01) |
| ***B65B 61/18*** | (2006.01) |
| ***B65B 65/02*** | (2006.01) |

(56) References Cited

U.S. PATENT DOCUMENTS

| | | | | |
|---|---|---|---|---|
| 2015/0082754 | A1* | 3/2015 | Jasiulek | B65B 43/52<br>53/251 |
| 2015/0274342 | A1* | 10/2015 | Zuccotti | B65B 7/28<br>53/133.2 |
| 2016/0207717 | A1* | 7/2016 | Senn | B65G 54/02 |
| 2016/0362208 | A1* | 12/2016 | Papsdorf | B65G 47/53 |
| 2017/0203865 | A1* | 7/2017 | Kalany | B65B 57/10 |
| 2018/0282076 | A1* | 10/2018 | Huber | B65G 43/08 |

FOREIGN PATENT DOCUMENTS

| | | | |
|---|---|---|---|
| EP | 3594141 | A1 | 1/2020 |
| WO | 2014097275 | A2 | 6/2014 |

* cited by examiner

METHOD FOR CONTROLLING A PLURALITY OF CARTS MOVABLE ALONG AN ENDLESS TRACK

TECHNICAL FIELD

The present invention relates to a method for controlling a plurality of carts movable independently from one another along an endless track, in particular a closed-loop track, and configured to carry out at least one operation onto respective articles, in particular a packaging-related operation, more in particular applying caps or closures onto packages containing a pourable product.

BACKGROUND ART

As it is generally known, many pourable food products, such as fruit juice, UHT (ultra-high temperature-treated) milk, wine, tomato sauce, etc., are sold in packages made of sterilized packaging material.

A typical example is the parallelepiped-shaped package for pourable food products known as Tetra Brik Aseptic (registered trademark), which is made by folding and sealing a laminated web of packaging material. The packaging material has a multilayer structure comprising a base layer, e.g. made of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Such packages are normally produced in fully automatic packaging assemblies, in which a continuous tube is formed from a web of packaging material fed to such packaging assembly. The web of packaging material is sterilized in the packaging assembly, e.g. by applying a chemical sterilizing agent, such as hydrogen peroxide solution, which, once sterilization is completed, is removed from the surfaces of the packaging material, e.g. evaporated by heating. The web so sterilized is then maintained in a closed, sterile environment, and is folded and sealed longitudinally to form the tube, which is fed along a vertical advancing direction.

In order to complete the forming operations, the tube is filled with the sterilized food product from above and is sealed and subsequently cut along equally spaced transversal cross sections.

Pillow packs are obtained thereby, which have a longitudinal sealing band, a top transversal sealing band and a bottom transversal sealing band.

The known packaging assemblies typically comprise a forming unit configured to form the pillow packs, wherein the tube is filled continuously downwards with the sterilized or sterile-processed food product and is formed, sealed and then cut along the above-mentioned cross-sections to obtain the pillow packs.

The pillow packs are then fed to a folding unit to form fully-folded finished packages.

Once formed, the aforementioned packages may undergo further processing, such as applying an opening device to enable the product to be poured out. In some embodiments, the opening devices are normally fitted directly onto the packages, after they are formed, sealed and folded, in application units placed on the production line downstream of the folding unit.

It is known the use of packaging assemblies comprising a plurality of carts movable independently from one other along respective tracks in order to carry out operations onto pillow packs or packages.

For example, it is known the use of such tracks and independently movable carts to form and seal or to fold the above-mentioned pillow packs.

For achieving the independent movement of the carts, linear motors are typically used.

Accordingly, each track is typically equipped with individually-excitable solenoids, e.g. electric coils, whilst each one of the carts is typically equipped with permanent magnets. The resulting linear motor is configured to independently control, in a known manner, the advancement of the carts along the respective track or tracks.

It is also known the use of carts independently movable from one another along an endless track to apply opening devices onto packages, as described in WO2014097275.

In particular, WO2014097275 describes an application unit for the application of opening devices onto respective sealed packages containing a pourable food product. The application unit comprises an endless, closed-loop track and a plurality of carts which move, in use, independently from one another along the track by means of a linear motor.

Each cart carries one gripping device configured to cyclically receive a respective opening device, to carry the opening device along the track and to apply the opening device onto one respective package which is advancing along an advancement path located underneath the track.

After being received and before being applied, each opening device is also spread with glue by means of a glue-spreading device, such as a glue gun.

The application of the opening device occurs along a branch of the track which is facing the advancement path.

Although reliable, effective and functionally valid, the aforementioned application units are still open to further improvement, in particular as to simplify the control of the carts along the endless track and to optimize the dynamics of the carts moving along the endless track.

Disclosure of Invention

It is therefore an object of the present invention to provide a method for controlling a plurality of carts movable independently from one another along an endless track and configured to carry out at least one operation onto respective articles, which is designed to meet at least one of the above-mentioned needs in a straightforward and low-cost manner.

This object is achieved by a method for controlling a plurality of carts movable independently from one another along an endless track as claimed in claim 1.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
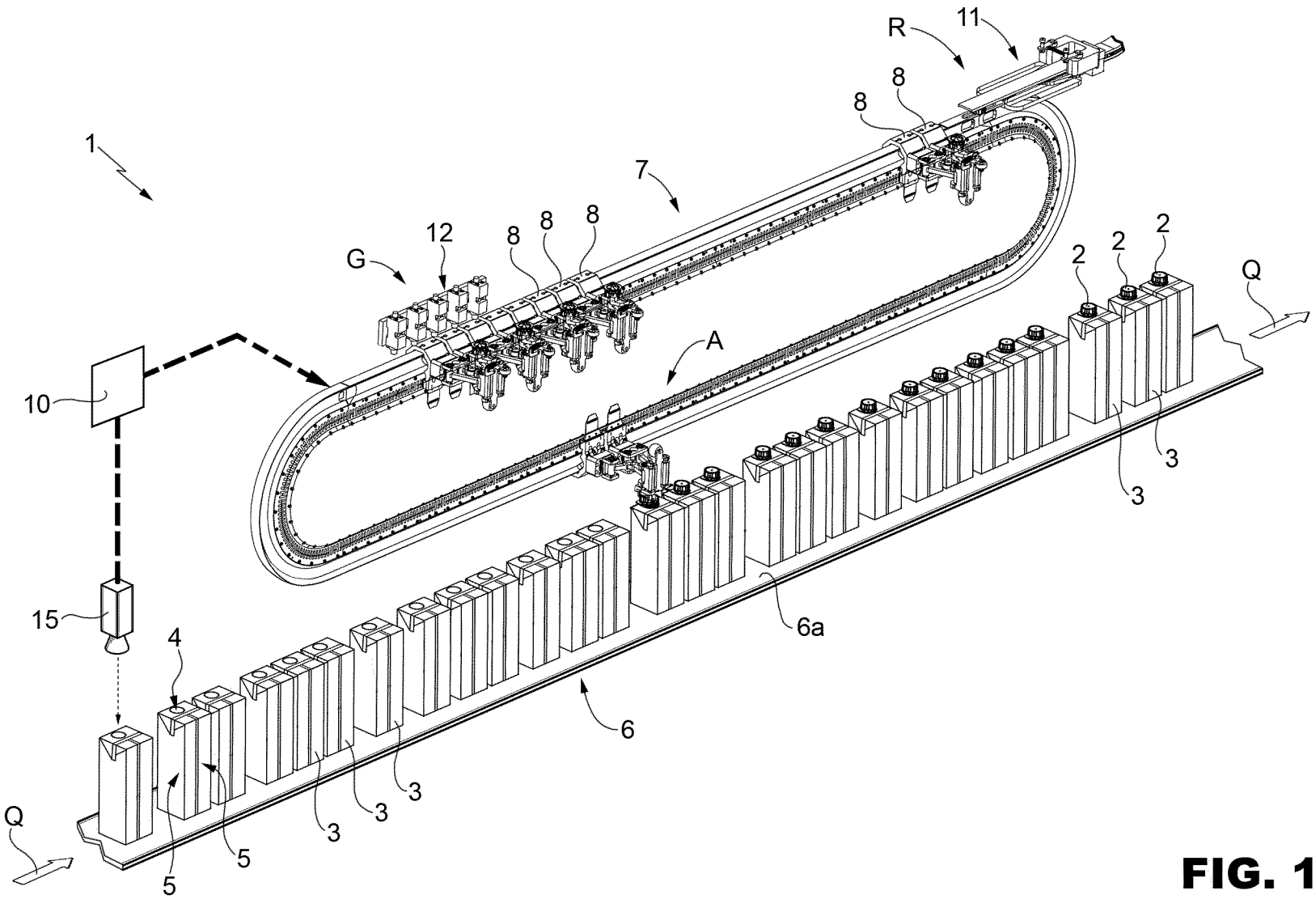
FIG. 1 shows a unit for applying opening devices onto sealed packages containing a pourable food product and operating according to the method for controlling a plurality of carts according to the present invention.

With reference to the enclosed figures, number 1 indicates as a whole a unit for applying opening devices 2 onto articles, in particular sealed packages 3 containing a pourable product, preferably a pourable food product, such as UHT or pasteurized milk, fruit juice, wine, water, etc.

Packages 3 are produced upstream of unit 1 by means of a known packaging machine (not shown) starting from a sheet of packaging material which is first folded into a tube, then sealed longitudinally, then formed and sealed transversally and, eventually, folded according to a process known per se and neither shown nor described in detail.

The packaging material, which has a multilayer structure (not shown), and comprises a layer of fibrous material, e.g. paper, covered on both sides with respective layers of heat-seal plastic material, e.g. polyethylene.

In the case of aseptic packages 3 for long-storage products, such as UHT milk, the packaging material also comprises a layer of gas-and-light barrier material, e.g. aluminum foil or ethylene vinyl alcohol (EVOH) film, which is superimposed on a layer of heat-seal plastic material, and is in turn covered with another layer of heat-seal plastic material, the latter forming the inner face of the packages 3 eventually contacting the pourable product.

Each opening device 2 is adapted to be applied on a package 3 at a removable portion thereof, i.e. a portion detachable from the remaining part of that package 3 to allow the outflow of the pourable product.

The removable portion may consist of a sealing sheet applied by gluing or heat sealing on package 3 to close a through-hole thereof; as an alternative, the removable portion may be defined by a so-called "prelaminated" hole, i.e. a hole formed in the base layer of the packaging material and closed hermetically by other layers (at least the layers of thermoplastic material) of the packaging material.

Each package 3 is, in the embodiment shown, parallelepiped and has a top wall 4 onto which a respective opening device 2 is applied by unit 1 and a bottom wall opposite to top wall 4.

Furthermore, each package 3 has a pair of lateral walls 5 extending orthogonally between top wall 4 and the bottom wall.

In the embodiment shown, top wall 4 lies in a horizontal plane.

Unit 1 substantially comprises:

- conveying means 6 configured for advancing packages 3 along a feeding path Q, rectilinear in the embodiment shown;
- an endless, closed-loop track 7;
- a plurality of carts 8 movably coupled to track 7 and movable, in particular slidable, along track independently from one another; and
- a control unit 10 operatively coupled with track 7 and carts 8.

Conveying means 6 comprises a linear conveyor **6*a* which extends along feeding path Q and cooperates, in use, with the bottom wall of packages 3 to feed packages 3** along feeding path Q.

In the embodiment shown, linear conveyor **6*a* advances packages 3** along feeding path Q with a random pitch.

Track 7 houses a stator armature (not shown) formed by a plurality of individually-excitable solenoids (known per se), and carts 8 house respective permanent magnets (known per se), so that carts 8 are independently moved, in use, along track 7 by individually controlling the solenoids by means of control unit 10.

In other words, track 7 and carts 8 together define a linear motor.

Preferably, track 7 has a substantially oval configuration.

In light of the above, since track 7 is endless in a closed-loop manner, each cart 8 is cyclically movable along track 7.

More in particular, carts 8 are configured to be continuously advanced along track 7, driven by the interaction between solenoids and permanent magnets controlled by control unit 10, according to a manner better described in the following.

Carts 8 are configured to perform at least one task, in particular a plurality of tasks, in order to carry out an operation onto the respective packages 3.

Accordingly, track 7 passes through an operation station at which the operation is carried out and linear conveyor **6*a* is configured to advance packages 3** through the operation station.

Hence, both track 7 and linear conveyor **6*a*** extend through (at) the operation station.

According to the preferred embodiment shown, each cart 8 is configured to perform three tasks: receiving and/or picking one opening device 2 at a receiving station R arranged along track 7; applying and/or determining the application of glue onto the opening device 2 previously received at receiving station R; and attaching the opening device 2, previously received and spread with glue, onto a respective package 3 advanced by conveying means 6.

To this end, unit 1 further comprises:

- an infeed assembly 11 configured to feed opening devices 2 to carts 8 at receiving station R; and
- a gluing assembly 12 arranged downstream of infeed assembly 11, with respect to a direction of advancement of carts 8 along track 7, and configured to apply a layer of glue, or of any suitable adhesive substance, onto fastening portions (not shown) of the respective opening devices 2 carried by the respective carts 8.

In detail, gluing assembly 12 is arranged at a gluing station G downstream of receiving station R.

Accordingly, track 7 has:

- a plurality of task sections 13, along which carts 8 are configured to perform a task, in the specific example one of the aforementioned tasks; and
- a plurality of transient sections 14, along which carts 8 are configured to advance inactively, i.e. without performing any of the aforementioned tasks.

It is hereby stated that the term "inactively" indicates the operative condition in which carts 8 continue to advance along track 7 and to perform all the predetermined movements, but in an "inactive way", for example without receiving an opening device or without being supplied with glue.

In practice, task sections 13 are located, in particular are defined, at the positions where infeed assembly 11 and gluing assembly 12 are arranged.

Moreover, a third task section 13 is located, in particular is defined, at the position where carts 8 attach, in use, the already received and spread-with-glue opening devices 2 onto packages 3, i.e. in a position downstream of the gluing assembly 12.

In light of the above, the above-mentioned operation to be carried out by each cart 8 onto one respective package 3 is defined by the application of one opening device 2 onto one respective package 3, and the above-mentioned tasks (receiving the opening device 2, applying glue to the opening device 2 and attaching the opening device 2 to the package) are part of such operation.

In other words, each operation is completed (carried out) as soon as all the tasks are performed.

Therefore, the above-mentioned operation station is defined by an application station A, at which each cart 8 applies (by performing the task of attaching and having already performed the task of receiving and the task of spreading with glue) one opening device 2 onto one respective package 3 advanced by the linear conveyor 6*a* at the application station A itself.

Conveniently, each cart 8 is equipped with a gripping device (not shown) configured to receive one opening device 2 at a time at receiving station R.

The gripping devices then apply, in particular attach, respective opening devices 2 onto respective packages 3 at application station A, the latter being located downstream of gluing station G.

Opportunely, this task is performed at a branch of track 7 facing linear conveyor 6*a*, in the embodiment shown a lower branch of track 7.

Preferably, infeed assembly 11 and gluing assembly 12 are arranged at an upper branch of track 7, the upper branch and the lower branch being connected to one another by two opposite curved branches.

Gluing assembly 12 is supported by a not-shown fixed structure of unit 1 and reciprocates parallel to the upper branch in order to follow carts 8 which move along the respective task section 13.

In an alternative non-shown embodiment, gluing assembly 12 could be standing still.

In particular, gluing assembly 12 comprises a plurality of glue spreading means, preferably guns for applying glue onto respective opening devices 2 carried by the carts 8 which are moving along the respective task section 13, according to a given pattern (i.e. a predetermined movement scheme, namely speed and acceleration scheme) known per se and determined by control unit 10.

For example, a group of carts 8 could be grouped by control unit 10 so as to define a batch of opening devices 2 to be spread with glue by the guns, all at once.

Namely, if gluing assembly 12 comprises five guns (clearly, the number of guns can be different, the above specified number being merely a preferred example), control unit 10 determines, in use, the grouping of five carts 8 carrying respective opening devices 2 to be grouped together within the respective task section 13.

It is stated that the verb "to group" can hereby indicate a conceptual grouping of carts 8 and not necessarily a physical one, e.g. involving a physical separation of the group of carts 8 from the other carts 8.

Unit 1 further comprises a sensor 15 for detecting the passage of each package 3 at a detection station D of feeding path Q located upstream of attachment station A, with respect to the direction of advancement of packages 3 along feeding path Q.

In practice, sensor 15 is configured to generate a signal correlated with the passage of each package 3 at detection station D and to send such signal to the control unit 10.

Track 7 further comprises a task-assignment section 16 located at a transient section 14, in particular in a position upstream of the receiving station R, i.e. in a position upstream of the task section 13 associated with the infeed assembly 11.

In practice, task-assignment section 16 is spaced from the other task sections 13, in particular from the task section 13 associated with the infeed assembly 11, along track 7.

Figure 2:
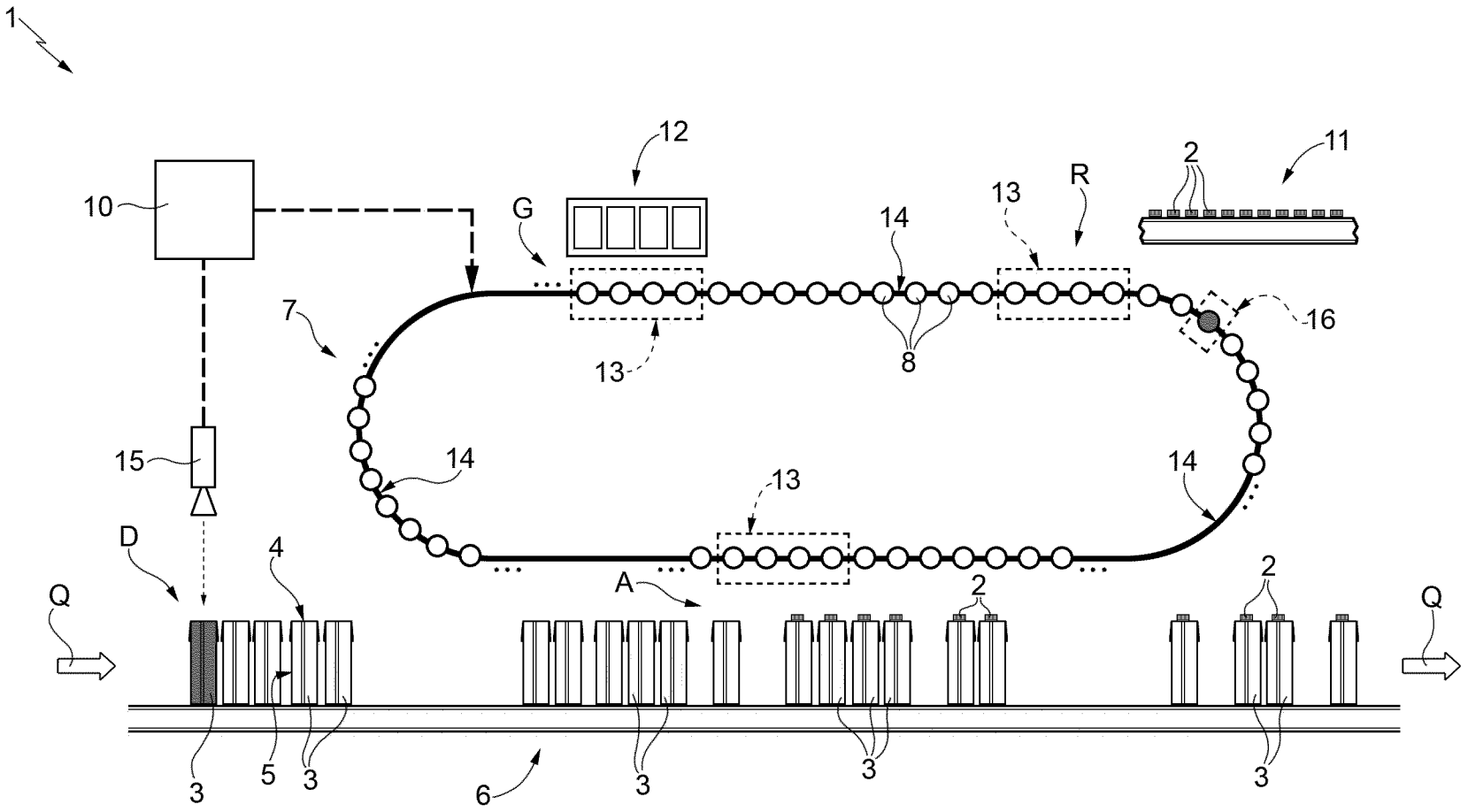
FIG. 2 is a schematic lateral view, with parts removed for clarity, of the unit of FIG. 1 during a given operative condition.

As schematically shown in FIG. 2, control unit 10 is configured to control a cart 8 to perform at least one of the above-mentioned tasks if a package 3 is detected by sensor 15 at detection station D when the cart 8 is moving along task-assignment section 16.

More specifically, control unit 10 is configured to control the cart 8 to perform all the above-mentioned tasks if a package 3 is detected by sensor 15 and, at the same time, the cart 8 is moving along task-assignment section 16.

Figure 3:
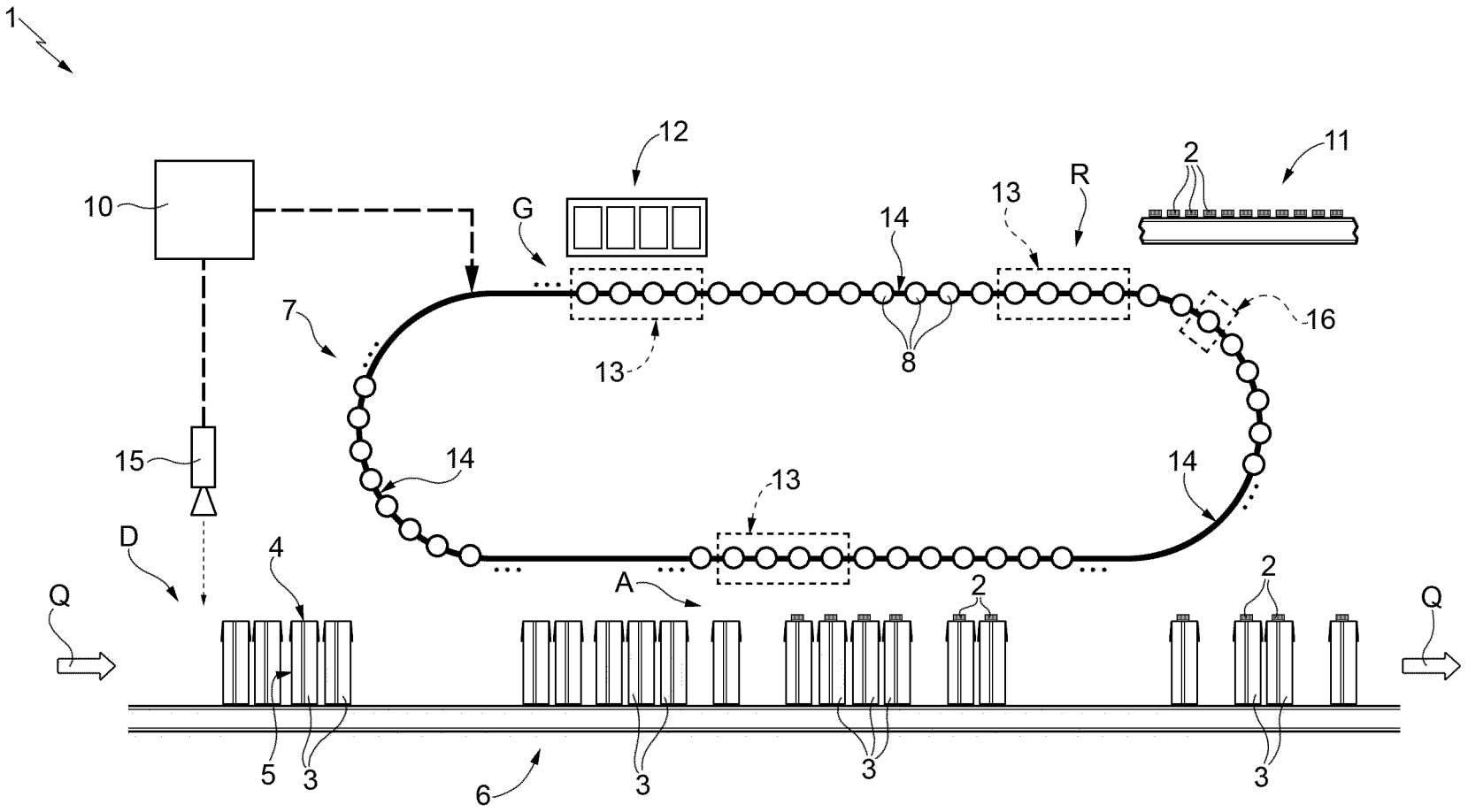
FIG. 3 is a schematic lateral view, with parts removed for clarity, of the unit of FIG. 1 during a further operative condition.

Furthermore, if no package 3 is detected by sensor 15 while a cart 8 is moving along task-assignment section 16, such cart 8 is not assigned any task; namely, control unit 10 prevents the assignment of any task to such cart 8 (FIG. 3).

It is hereby stated that the above sentence "such cart 8 is not assigned any task" means that cart 8 continues to advance along track 7, without however performing any of the above-mentioned tasks.

Conveniently, however, such cart 8 continues to move according to the predetermined movement scheme, i.e. speed and acceleration scheme, imparted by control unit 10. For example, in an embodiment, carts 8 that are task will not assigned any perform the minor acceleration and/or decelerations along track 7 that they would have performed if assigned the tasks.

In practice, there is no need for overall non-predetermined acceleration and/or deceleration of carts 8 along track 7, whilst minor predetermined acceleration and/or deceleration could still happen due to the predetermined movement scheme.

In light of the above, if a cart 8 is moving along task-assignment section 16 when a package 3 is detected by sensor 15, control unit 10 controls such cart 8 to perform the above-mentioned tasks. In this case, and for the same cycle of that cart 8 along track 7, that cart 8 actively moves along task sections 13 and, therefore, receives an opening device 2 at receiving station R, glue is applied onto the opening device 2 carried by that cart 8 and that cart 8 attaches the respective opening device 2 onto the previously detected package 3.

Hence, control unit 10 is further configured to associate the detected package 3 to the respective cart 8 moving along task-assignment section 16 when that package 3 is detected, so that the cart 8 performs the whole operation on the detected package 3 (FIG. 2).

In the case in which a cart 8 crosses the whole task-assignment section 16 but no package 3 is detected by sensor 15 in the meantime, for example due to the random pitch with which packages 3 are advanced by linear conveyor 6*a*, the cart 8 is controlled by control unit 10 to move inactively along the entirety of track 7, i.e. the cart 8 does not perform any task and, therefore, any operation (FIG. 3).

The above configuration allows to advance carts 8 along track 7 in a continuous manner, namely without the need for actively accelerating or decelerating carts 8 in relation to the positions of packages 3 along linear conveyor 6*a*.

In practice, carts 8 are substantially neither accelerated, nor decelerated along track 7. Instead, carts 8 are merely assigned or not assigned the tasks, in relation to their presence within task-assignment section 16 while a package 3 is detected by sensor 15.

As said, carts 8 continue to advance along track 7 with the predetermined minor acceleration or deceleration according to the predetermined movement scheme.

This results in an improvement of the overall dynamics of carts 8 along track 7, preventing also any undesired collision between carts 8.

Furthermore, it is ensured that the detected package 3 is always handled by the "first" available cart 8 passing through the task-assignment section 16 when package 3 is detected.

Conveniently, task-assignment section 16 is suitably narrow so that only one single cart 8 at a time moves, i.e. is advanced, along task-assignment section 16.

Therefore, task-assignment section 16 has an extension smaller than the extension of transient sections 14, in particular of the transient section 14 at which task-assignment section 16 is located.

Preferably, packages 3 are advanced by linear conveyor 6*a* with a predetermined minimum distance between one another, for example by means of a known spacer device arranged upstream of detection station D.

More specifically, packages 3 reach detection station D with a predetermined minimum distance between one another.

This prevents any collision between carts 8 that may occur due to the association of two successive carts 8 with two successive packages 3 which are too close to one another.

The operation of unit 1 is described hereinafter with reference to a single cart 8 advancing along track 7 and starting from a condition in which such cart 8 is located upstream of task-assignment section 16 and a package 3 is advanced by linear conveyor 6*a* and is located upstream of detection station D.

When package 3 reaches detection station D, it is detected by sensor 15.

At the same time, control unit 10 controls the cart 8 moving along task-assignment section 16 to perform the above-mentioned tasks and, therefore, controls cart 8 to carry out the operation, i.e. the application of one respective opening device 2 onto the detected package 3.

In practice, control unit 10 associates such cart 8 with the detected package 3 (FIG. 2).

If a cart 8 is moving along task-assignment section 16 but no package 3 is detected in the meanwhile, for example due to the random pitch with which packages 3 are advanced, no task is assigned to that cart 8 (FIG. 3).

However, as stated above, that cart 8 continues to advance along track 7 according to its predetermined movement scheme.

Once each cart 8 has passed downstream of application station A, it is advanced towards task-assignment section 16 again, and another cycle begins.

The advantages of unit 1 and of the method of controlling a plurality of carts 8 independently moving along track 7 according to the present invention will be clear from the foregoing description.

In particular, the above-described configuration and method of controlling allows to advance carts 8 along track 7 in a continuous manner, namely without the need for overall actively accelerating or decelerating carts 8 in relation to the positions of packages 3 along linear conveyor 6*a*. In fact, carts 8 are controlled to move along track 7, i.e. along task sections 13 and transient sections 14 without performing any task, if they are not assigned one according to the above-explained conditions. Thus, the distribution of carts 8 along track 7 is kept substantially constant, even if packages 3 are not present or are not detected by sensor 15. In other words, carts 8 can be continuously advanced along track 7 with substantially a predetermined speed profile.

This results in an improvement of the overall dynamics of carts 8 along track 7.

Furthermore, thanks to the above described configuration and method of controlling, unit 1 is able to automatically adapt its capacity of processing packages 3 supplied to conveying means 6.

In practice, unit 1 is independent from the pitch at which packages 3 are supplied.

Clearly, changes may be made to unit 1 as described herein without, however, departing from the scope of protection as defined in the accompanying claims.

In particular, a method for controlling according to the invention could be implemented in any suitable unit comprising a plurality of carts independently movable along an endless track, wherein the carts are configured to perform at least one task in order to carry out at least one operation onto articles.

The invention claimed is:

1. A method for controlling a plurality of carts movable independently from one another along an endless track and configured to perform at least one task in order to carry out at least one operation onto respective articles; the method comprising the steps of:

a) advancing the carts along said track, said track comprising at least one task section and at least one transient section;

b) advancing each cart along a task-assignment section of said track arranged upstream of said at least one task section;

c) advancing a plurality of said articles along a feeding path and through an operation station at which said operation is carried out;

d) detecting the passage of each article at a detection station of the feeding path located upstream of said operation station; and e) controlling one respective cart to perform the at least one task if an article is detected, during the step d) of detecting, when the cart is moving along said task-assignment section, wherein each cart of the plurality of carts comprises a gripping device and is actuated by a control unit to perform the at least one task when the cart passes the task assignment section as an article is detected at the detection station, and wherein the step e) of controlling comprises the step of:

f) preventing the cart from performing the at least one task if no article is detected during the step d) of detecting and while the cart is moving along said task-assignment section, and not actuating the gripping device to perform the at least one task if no article is detected during the step d) of detecting and while the cart is moving along said task-assignment section.

2. The method as claimed in claim 1, wherein the step a) of advancing comprises advancing continuously the carts along said track.

3. The method as claimed in claim 1, wherein the step c) of advancing is carried out by advancing the plurality of articles along the feeding path with a random pitch.

4. The method as claimed in claim 3, wherein the step c) of advancing is carried out by advancing the plurality of articles along the feeding path with a predetermined minimum distance between one another.

5. The method as claimed in claim 1, wherein the step b) of advancing is carried out by advancing one single cart at a time along the task-assignment section.

6. The method as claimed in claim 1, wherein the step e) of controlling further comprises the step of:

g) associating the detected article to the respective cart moving along the task-assignment section when the detected article is detected, so that said cart performs said operation on said detected article.

7. The method as claimed in claim 1, wherein said task-assignment section has an extension smaller than the extension of said transient section.

8. The method as claimed in claim 1, wherein the at least one task to be performed by said carts is selectable among:

receiving and/or picking an opening device from a receiving station arranged along said track downstream of the task-assignment section;

applying and/or determining the application of glue onto the opening device at a gluing station arranged along said track downstream of the receiving station;

attaching the opening device, previously received by a respective cart and previously spread with glue, onto an article adapted to contain a pourable product, at an application station downstream of said gluing station; or a combination of the above.

9. A method for controlling a plurality of carts movable independently from one another along an endless track and configured to perform at least one task in order to carry out at least one operation onto respective articles; the method comprising the steps of:

a) advancing the carts along said track, said track comprising at least one task section and at least one transient section;

b) advancing each cart along a task-assignment section of said track arranged upstream of said at least one task section;

c) advancing a plurality of said articles along a feeding path and through an operation station at which said operation is carried out;

d) detecting the passage of each article at a detection station of the feeding path located upstream of said operation station; and e) controlling one respective cart to perform the at least one task if an article is detected, during the step d) of detecting, when the cart is moving along said task-assignment section, wherein the step e) of controlling comprises preventing the cart from performing the at least one task if no article is detected during the step d) of detecting, and while the cart is moving along said task-assignment section, and wherein the step e) of controlling comprises the step of:

f) preventing the cart from performing the at least one task if no article is detected during the step d) of detecting and while the cart is moving along said task-assignment section, and not actuating the gripping device to perform the at least one task if no article is detected during the step d) of detecting and while the cart is moving along said task-assignment section.

* * * * *